US005666807A

United States Patent [19]

Bianchetta

[11] Patent Number: 5,666,807

[45] Date of Patent: Sep. 16, 1997

[54] OIL PROCESSOR CIRCUIT

[75] Inventor: Donald L. Bianchetta, Coal City, Ill.

[73] Assignee: Caterpillar Inc., Peoria, Ill.

[21] Appl. No.: 571,336

[22] Filed: Dec. 13, 1995

[51] Int. Cl.[6] ..... F15B 21/04

[52] U.S. Cl. ..... 60/329; 165/280

[58] Field of Search ..... 60/329, 456; 165/280, 165/297, 298; 236/84

[56] References Cited

U.S. PATENT DOCUMENTS

| | | | |
|---|---|---|---|
| 3,174,410 | 3/1965 | Booth et al. | 60/329 |
| 3,498,061 | 3/1970 | Prucha et al. | 60/329 X |
| 4,306,966 | 12/1981 | Lucia | 210/85 |
| 4,487,255 | 12/1984 | Bianchetta et al. | 165/39 |
| 4,680,928 | 7/1987 | Nishikawa et al. | 60/329 |
| 5,165,377 | 11/1992 | Hosseini | 123/41.12 |
| 5,395,519 | 3/1995 | Miller | 210/149 |

*Primary Examiner*—Gerald A. Michalsky
*Attorney, Agent, or Firm*—John W. Grant

[57] ABSTRACT

Oil coolers are commonly used in hydraulic systems for maintaining oil below a preselected temperature under normal operating conditions. The subject oil cooler circuit includes a pilot operated valve disposed in a conduit connecting the hydraulic system to the cooler and an electromagnetic pilot valve connected to one end of the pilot operated valve. The pilot valve is spring biased to its closed position when the temperature of the oil is above a predetermined temperature and is moved to an open position when the oil temperature is at or below the predetermined temperature. The end is vented to a tank at the open position of the pilot valve so that the pilot operated valve is maintained at the closed position to prevent cold viscous oil from being transmitted to the oil cooler when the oil temperature is below the predetermined temperature.

3 Claims, 1 Drawing Sheet

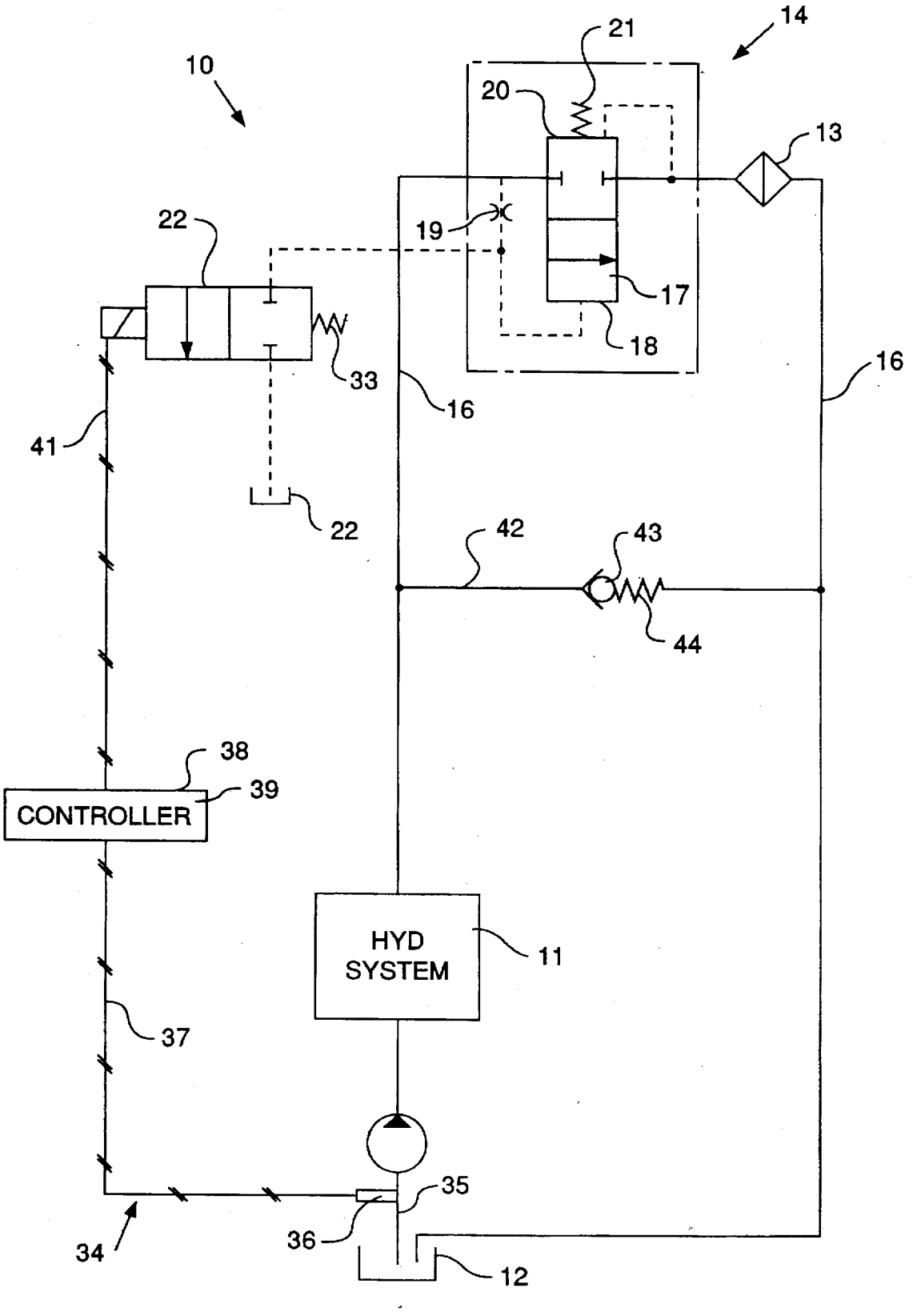
10
14
21
20
13
22
19
17
18
33
16
16
41
22
42
43
44
38
39
CONTROLLER
HYD
SYSTEM
11
37
35
36
34
12

OIL PROCESSOR CIRCUIT

TECHNICAL FIELD

This invention relates to an oil processor circuit and, more particularly, to a circuit in which oil through the processor is blocked when the temperature of the oil is below a predetermined temperature.

BACKGROUND ART

The hydraulic system of many machines have an oil processing circuit such as an oil cooler for cooling the oil being returned to a hydraulic tank. One of the problems encountered is that the oil becomes extremely viscous at extremely cold temperatures and some failures have occurred in the cooler due to high oil pressures generated by forcing the viscous oil through the cooler when a cold machine is started and then operated at normal speeds before the hydraulic system has warmed sufficiently. Another problem encountered is that an oil cooling fan associated with the oil cooler on some systems runs continuously and the oil cannot reach normal operating temperatures in cold ambient conditions.

In view of the above, it would be desirable to provide an oil cooler circuit in which oil flow through the cooler is prevented when the oil temperature is at or below a predetermined level.

The present invention is directed to overcoming one or more of the problems as set forth above.

DISCLOSURE OF THE INVENTION

In one aspect of the present invention, an oil processor circuit has an oil processor connected to a tank and a supply conduit connected to the cooler. A valve means disposed in the supply conduit has open and closed positions and is movable to one of the positions in response to receiving a control signal. A means is provided for sensing the temperature of oil in the circuit and for outputting the control signal to the valve means when the oil temperature is at or one side of a predetermined temperature.

BRIEF DESCRIPTION OF THE DRAWINGS

The sole figure is a schematic illustration of an embodiment of the present invention.

BEST MODE FOR CARRYING OUT THE INVENTION

An oil processor circuit such as an oil cooler circuit 10 is disposed between a hydraulic system 11 and a tank 12 and has an oil cooler 13 connected to the tank 12. An electromagnetic valve means 14 is disposed in a conduit 16 connecting the hydraulic system to the oil cooler 13 and has open and closed positions. The valve means is movable to one of the positions in response to receiving a control signal. In this embodiment, the valve means includes a pilot operated valve 17 disposed in the conduit and having an end 18 connected to the conduit upstream of the valve through an orifice 19 and another end 20 connected to the conduit downstream of the valve. The valve 17 is movable between open and closed positions and is biased to the closed position by a spring 21 disposed at the end 20. A two position electromagnetic or solenoid pilot valve 22 is connected to the end 18 and is biased to a closed position shown by a spring 23. The pilot valve 22 is moved rightward to connect the end 18 to the tank in response to receiving a control signal so that the valve 18 is biased to the closed position.

A means 34 is provided for sensing the temperature of the oil in the circuit and outputting a temperature signal when the oil temperature is at or on one side of a predetermined temperature. The sensing means 34 in this embodiment is a temperature sensor 36 disposed to sense the temperature in a suction line 35 of the pump and outputs a temperature signal through a line 37 when the oil temperature is at or below a predetermined temperature.

A control means 38 is provided for processing the command signal, for producing the control signal in response to the command signal, and for outputting the control signal to the pilot valve 22 of the valve means 14. The control means in this embodiment includes a controller 39 connected to the temperature sensor 36 through the electrical line 37 and to the pilot valve 22 through a line 41.

A bypass line 42 communicates the conduit 16 with the tank and has a bypass valve 43 disposed therein to bypass oil around the oil cooler through the bypass line when the valve means is in its closed position. The bypass valve in this embodiment is a check valve having a spring 44 biasing the valve to the closed position with the preload of the spring being selected to maintain the check valve at the closed position when the pilot operated valve 18 is in its open position.

Alternatively, the valve means 14 can include an electromagnetically actuated valve connected directly to the controller 39.

Industrial Applicability

In use, the temperature sensor 36 senses the temperature of the oil in the suction line and directs a temperature signal to the controller 39. The controller processes the temperature signal, produces the control signal in response to the temperature being at or below a predetermined temperature and outputs the control signal to the solenoid valve 22. The control signal energizes the solenoid valve 22 causing it to move rightward to the open position venting the end 18 of the valve 17 to the tank 12. This prevents a pressure buildup at the end 18 and the valve 17 is urged by the spring 21 to the closed position shown thereby blocking oil flow through the cooler 13. When the valve 17 is in the closed position shown, oil from the hydraulic system 11 passes through the check valve 43 to the hydraulic tank 12.

When the oil temperature exceeds the predetermined temperature, the controller 39 stops outputting the control signal to the solenoid valve 22 thereby allowing the spring 33 to bias the solenoid valve to the closed position shown blocking communication from the end 18 to the tank 12. This allows the fluid in the conduit 16 to generate pressure at the end 18 to overcome the bias of the spring 21 so that the valve 17 is moved to the open position communicating fluid through the cooler 13. In this embodiment, the valve 17 opens at a lower pressure than the check valve 43.

In view of the above, it is readily apparent that the structure of the present invention provides an improved oil cooler circuit in which oil flow to the oil cooler is shut off when the temperature of the oil is below a predetermined temperature. This is accomplished by providing an electromagnetic valve means upstream of the oil cooler and moving the valve means to a closed position when the temperature drops below a predetermined temperature. A bypass valve bypasses oil around the cooler when the valve means is in the closed position. This blocks the flow of high viscous oil through the cooler at low ambient temperatures. Moreover, this allows the hydraulic system to reach normal operating temperatures in cold ambient conditions.

Other aspects, objects and advantages of this invention can be obtained from a study of the drawings, the disclosure and the appended claims.

I claim:

1. An oil processor circuit having an oil processor connected to a tank and a conduit connected to the oil processor, comprising:

a pilot operated valve disposed in the conduit and having open and closed positions, first and second ends, an orifice communicating pressurized fluid from the conduit upstream of the pilot operated valve to the first end, and a spring disposed at the second end biasing the valve to one of said positions;

a two position electromagnetic pilot valve connected to the first end of the pilot operated valve and being movable to an open position communicating the first end to the tank to establish said one position of the pilot operated valve in response to receiving an electrical control signal; and means for sensing the temperature of the oil in the circuit and for outputting the electrical control signal to the electromagnetic pilot valve when the oil temperature is at or on one side of a predetermined temperature.

2. The oil processor circuit of claim 1 wherein the temperature sensing means includes a temperature sensor for outputting a temperature signal when the oil temperature is at or on one side of the predetermined temperature, and a control means for receiving and processing the temperature signal, for producing the electrical control signal in response to the temperature signal, and for outputting the electrical control signal to the electromagnetic pilot valve.

3. The oil processor circuit of claim 2 wherein the one position is the closed position.

* * * * *